US010271614B2

(12) United States Patent
Huard et al.

(10) Patent No.: US 10,271,614 B2
(45) **Date of Patent: *Apr. 30, 2019**

(54) SOLE ASSEMBLY FOR ARTICLE OF FOOTWEAR

(71) Applicant: Wolverine Outdoors, Inc., Rockford, MI (US)

(72) Inventors: Roger L. Huard, Rockford, MI (US); Myra G. De La Cruz-Williams, Ada, MI (US); Ian M. Cobb, Wixom, MI (US); Yahn C. Lebo, Rockford, MI (US); Ryan C. Dowd, Indianapolis, IN (US)

(73) Assignee: Wolverine Outdoors, Inc., Rockford, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/446,361

(22) Filed: Mar. 1, 2017

(65) Prior Publication Data

US 2017/0202305 A1 Jul. 20, 2017

Related U.S. Application Data

(63) Continuation of application No. 14/857,199, filed on Sep. 17, 2015, now Pat. No. 9,615,625.

(51) Int. Cl.
*A43B 13/12* (2006.01)
*A43B 13/18* (2006.01)
(Continued)

(52) U.S. Cl.
CPC ..... *A43B 13/186* (2013.01); *A43B 7/141* (2013.01); *A43B 7/142* (2013.01); *A43B 7/144* (2013.01); *A43B 13/026* (2013.01); *A43B 13/04* (2013.01); *A43B 13/12* (2013.01); *A43B 13/122* (2013.01); *A43B 13/125* (2013.01); *A43B 13/127* (2013.01); *A43B 13/14* (2013.01);
(Continued)

(58) Field of Classification Search
CPC ..... A43B 13/127; A43B 13/12; A43B 13/14; A43B 13/122; A43B 13/125; A43B 13/141
USPC ..... 36/25 R, 30 R, 31
See application file for complete search history.

(56) References Cited

U.S. PATENT DOCUMENTS 3,081,774 A 3/1963 Lelyveld
5,052,130 A 10/1991 Barry et al.
(Continued)

*Primary Examiner* — Marie D Bays
(74) *Attorney, Agent, or Firm* — Warner Norcross + Judd LLP

(57) ABSTRACT

A sole assembly for an article of footwear having a midsole defining a sidewall channel in the forefoot and a sidewall channel in the heel. The forefoot and heel channels terminate at the arch. The sole assembly includes a plate disposed below the midsole. The plate may include an arch portion, forefoot legs extending along the medial and lateral sides of the forefoot and heel legs extending along the medial and lateral sides of the heel. The medial forefoot leg may extend almost the full length of the forefoot. The lateral forefoot leg may extend about half-way through the forefoot. The lateral heel leg may extend almost the full length of the heel. The medial heel leg may extend about half-way through the heel. The sole assembly may include an outsole with slots in the heel and forefoot. The slots may terminate short of the peripheral edge.

12 Claims, 11 Drawing Sheets

(51) Int. Cl.

| | |
|---|---|
| ***A43B 13/14*** | (2006.01) |
| ***A43B 7/14*** | (2006.01) |
| ***A43B 13/04*** | (2006.01) |
| ***A43B 13/22*** | (2006.01) |
| ***A43B 13/42*** | (2006.01) |
| ***A43B 13/02*** | (2006.01) |

(52) U.S. Cl.
CPC ..... *A43B 13/141* (2013.01); *A43B 13/185* (2013.01); *A43B 13/187* (2013.01); *A43B 13/188* (2013.01); *A43B 13/223* (2013.01); *A43B 13/42* (2013.01)

(56) References Cited

U.S. PATENT DOCUMENTS

| | | | | |
|---|---|---|---|---|
| 5,185,943 | A | 2/1993 | Tong et al. | |
| 5,465,507 | A | 11/1995 | Schumacher | |
| 5,845,420 | A | 12/1998 | Buccianti et al. | |
| D418,282 | S | 1/2000 | von Conta | |
| 6,199,302 | B1 | 3/2001 | Kayano | |
| 6,199,303 | B1 | 3/2001 | Luthi | |
| 6,477,791 | B2 | 11/2002 | Luthi et al. | |
| 6,954,998 | B1 | 10/2005 | Lussier | |
| 7,082,702 | B2 | 8/2006 | Cretinon | |
| 7,299,567 | B2 | 11/2007 | Berend | |
| 7,377,057 | B2 | 5/2008 | Lacorazza | |
| RE40,474 | E | 9/2008 | Quellais et al. | |
| 7,707,748 | B2 | 5/2010 | Campbell | |
| 7,954,259 | B2 | 6/2011 | Antonelli et al. | |
| 7,997,013 | B2 | 8/2011 | Reilly | |
| 8,256,146 | B2 | 9/2012 | Loverin | |
| D671,305 | S | 11/2012 | Escobar | |
| 8,341,856 | B2 | 1/2013 | Smith | |
| 8,984,775 | B2 | 3/2015 | Dombrow | |
| 9,615,625 | B1 * | 4/2017 | Huard ..... | A43B 13/026 |
| 2002/0144431 | A1 | 10/2002 | Knoerr | |
| 2005/0022426 | A1 | 2/2005 | Clark | |
| 2005/0267775 | A1 | 12/2005 | Willis | |
| 2006/0143950 | A1 | 7/2006 | Beak | |
| 2008/0060225 | A1 | 3/2008 | Kilgore | |
| 2008/0244926 | A1 | 10/2008 | Yu | |
| 2008/0282579 | A1 | 11/2008 | Bobbett | |
| 2010/0293816 | A1 | 11/2010 | Truelsen | |
| 2012/0233877 | A1 | 9/2012 | Swigart | |
| 2013/0125419 | A1 | 5/2013 | Smith | |
| 2013/0133225 | A1 | 5/2013 | Linth | |
| 2013/0219752 | A1 * | 8/2013 | Dombrow ..... | A43B 23/0295 36/102 |
| 2014/0223776 | A1 | 8/2014 | Wardlaw et al. | |
| 2014/0366403 | A1 | 12/2014 | Reinhardt | |

* cited by examiner

SOLE ASSEMBLY FOR ARTICLE OF FOOTWEAR

BACKGROUND OF THE INVENTION

The present invention relates to footwear, and more particularly to a sole assembly for an article of footwear.

A typical article of footwear includes an upper and a sole assembly. The general function of the upper is to receive the wearer's foot and secure it to the sole assembly. Uppers are available in a wide variety of shapes and style for forming a broad range of categories of footwear, such as casual shoes, dress shoes, athletic shoes, work boots, dress boots, outdoor boots, casual sandals, dress sandals and performance sandals. The sole assembly is affixed to the undersurface of the upper and its general function is to provide a layer of protection for the wearer's foot. The sole assembly can be designed not only to protect the foot from contact with the ground, but also to provide improved comfort and support for the foot.

There is an ongoing effort to develop new and improved sole constructions that provide optimal performance across various applications. To provide enhanced support, energy return and durability, it is not uncommon to incorporate a relatively rigid plate into a sole assembly. A typical plate is configured to resiliently bend during normal use to, among other things, store energy during heel strike and return it to the wearer during toe off. Conventional plate constructions can suffer from a number of typical problems. Because plates are relatively rigid, it can be difficult to develop a sole assembly with a plate that provides adequate support while remaining comfortable for day to day use. Although the stiffness of a plate can be reduced to improve flexibility, if the stiffness is reduced too much the support, energy return and durability functions of the plate can be defeated. As a result, incorporation of a plate into a sole assembly typically requires a balance between the competing objectives of comfort on the one hand and support, energy return and durability on the other hand.

Despite continuing efforts, there remains a need for a sole assembly that provides an appropriate balance between comfort, support, energy return and durability.

SUMMARY OF THE INVENTION

The present invention provides a sole assembly for an article of footwear having a midsole with sidewall channels in the forefoot and the heel, and a plate that is disposed below the midsole. The sidewall channels may be of sufficient depth to enhance forefoot and heel compression—particularly around the peripheral edges of the midsole in the forefoot and heel. The forefoot and heel channels may terminate at or short of the arch so that the compression characteristics of the arch are essentially unaffected by the channels. The plate may include forefoot legs that extend along the medial and lateral sides of the forefoot in regions where compression is enhanced by the forefoot channel. Similarly, the plate may include heel legs that extend along the medial and lateral sides of the heel in regions where compression is enhanced by the heel channel. The sole assembly may also include an outsole with longitudinally-extending central channels in the heel and forefoot. The outsole channels provide a level of isolation between the lateral and medial sides of the sole assembly, thereby facilitating an enhanced degree of independence between the lateral and medial legs of the plate in both the forefoot and heel.

In one embodiment, the forefoot channel extends around the perimeter of the forefoot region beginning at or forward of the arch on the medial side and terminating at or forward of the arch on the lateral side. The forefoot channel may include a main portion that extends generally parallel to the upper surface of the midsole and transition portions that extend downwardly from the main portion toward the arch on opposite ends of the forefoot channel. The main portion of the forefoot channel may be of substantially uniform depth along its length and the transition portions of the forefoot channel may taper to a shallower depth as they approach the arch.

In one embodiment, the heel channel extends around the perimeter of the heel region. The heel channel may begin at or rearward of the arch on the medial side and may terminate at or rearward of the arch on the lateral side. The heel channel may include a main portion that extends generally parallel to the upper surface of the midsole and transition portions that extend downwardly from the main portion toward the arch on opposite end of the heel channel. The main portion of the heel channel may be of substantially uniform depth along its length and the transition portions of the heel channel may taper down to a shallower depth as they approach the arch.

In one embodiment, the support plate is generally H-shaped having an arch member extending laterally across the arch region and a plurality of legs that extend longitudinally from the arch member into the forefoot and into the heel. The arch member may be largely coextensive with the arch region extending almost the full lateral width of the sole and filling almost the full longitudinal space between the forefoot and the heel. The legs may extend from opposite ends of the arch member.

In one embodiment, the plate includes a pair of forefoot legs that extend forwardly from the arch portion along medial and lateral sides of the forefoot. In one embodiment, the lateral forefoot leg is shorter than the medial forefoot leg. The lateral forefoot leg may extend approximately half way into the forefoot. The medial forefoot leg may extend almost the full length of the forefoot.

In one embodiment, the plate includes a pair of heel legs that extend rearwardly from the arch portion along medial and lateral sides of the heel. In one embodiment, the lateral heel leg is longer than the medial heel leg. The medial heel leg may extend approximately half way into the heel. The lateral heel leg may extend almost the full length of the heel and its inner edge may extend along an angle toward the medial side of the heel.

In one embodiment, the outsole is disposed below the plate and the midsole. The outsole may generally include an arch region, a forefoot region and a heel region. The forefoot region may generally correspond with the shape of the plate. The forefoot region may include a medial portion and a lateral portion that are separated by a generally longitudinally-extending central slot. The heel region may include a medial portion and a lateral portion that are separated by a generally longitudinally-extending central slot.

In one embodiment, the outsole may define a heel slot that has a main portion extending in longitudinal direction and an end portion that is angled toward the medial side of the outsole. The angled end portion of the groove may be configured so that the center portion of the outsole at the rear of the heel is generally continuous. As a result, the sole assembly may provide enhanced support in response to the forces applied to that region during heel strike.

The present invention provides an outsole assembly that combines a high degree of comfort with enhanced durability, support and energy-return. The midsole channels provide improved compression in a way that facilitates bending action of the plate. The plate provides supplemental support storing and returning energy with each stride. With extended legs in lateral side of the heel and the medial side of the forefoot, the plate may be configured to provide optimum support and energy return for a typical gait, which follows a generally "S"-shaped profile from heel strike to toe off. The use of separate lateral and medial legs results in improved independence in compression and movement between lateral and medial portions of the sole. The arch portion of the plate provides a high degree of support in the arch region while the leg configuration allows more independent support the lateral and medial sides of the sole. The medial forefoot leg may be extended to provide supplemental support through the full longitudinal extent of the forefoot. The lateral forefoot leg may be shorter to provide supplemental support through only the rear of the forefoot. The lateral heel leg may be extended to provide supplemental support through the full longitudinal extent of the heel. The central slot in the heel of the outsole may include an angled end section that extends into the medial portion at the rear of the heel to improve support for forces applied toward the rear, center of the heel during heel strike. The medial heel leg may be shorter to provide supplemental support through only the forward portion of the heel.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DESCRIPTION OF THE CURRENT EMBODIMENT

Figure 1:
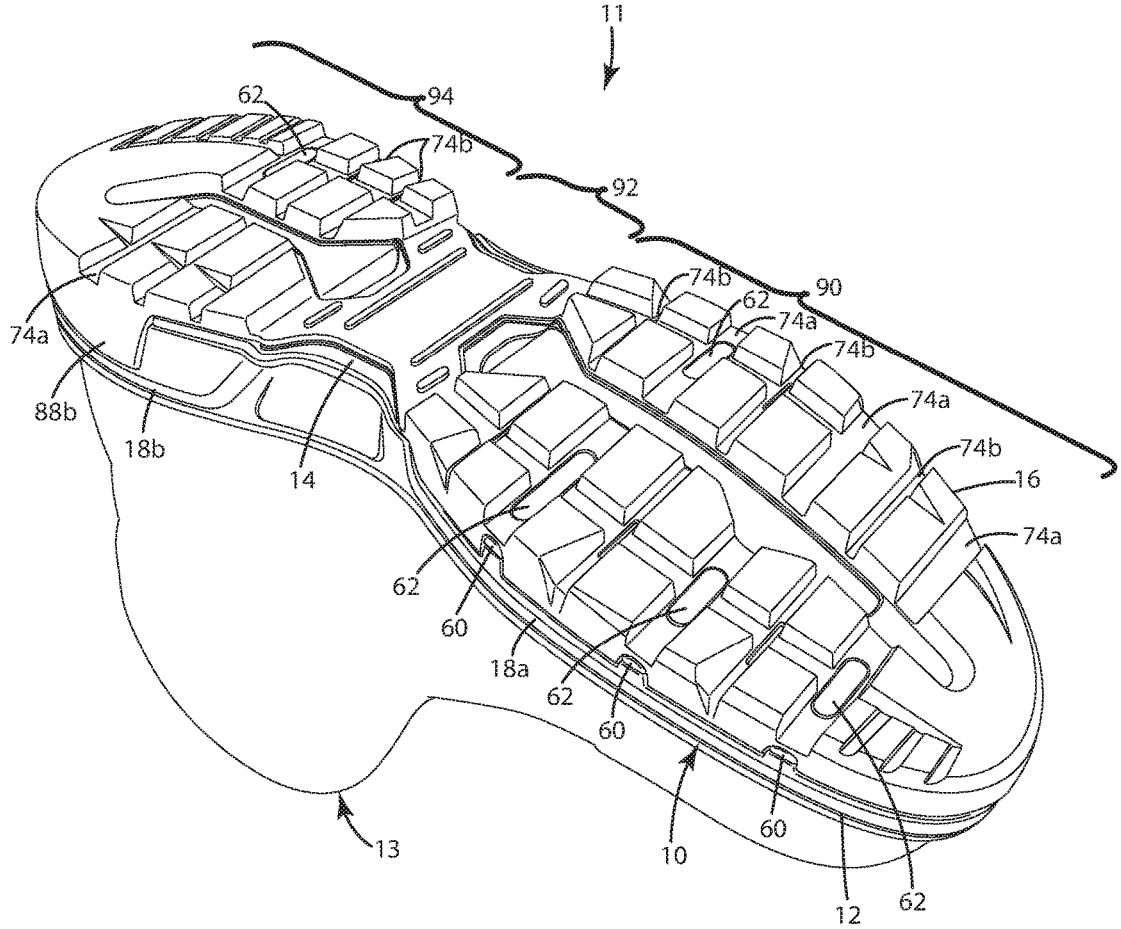
FIG. 1 is a front, right, bottom perspective view of an article of footwear incorporating a sole assembly in accordance with an embodiment of the present invention.
Figure 2:
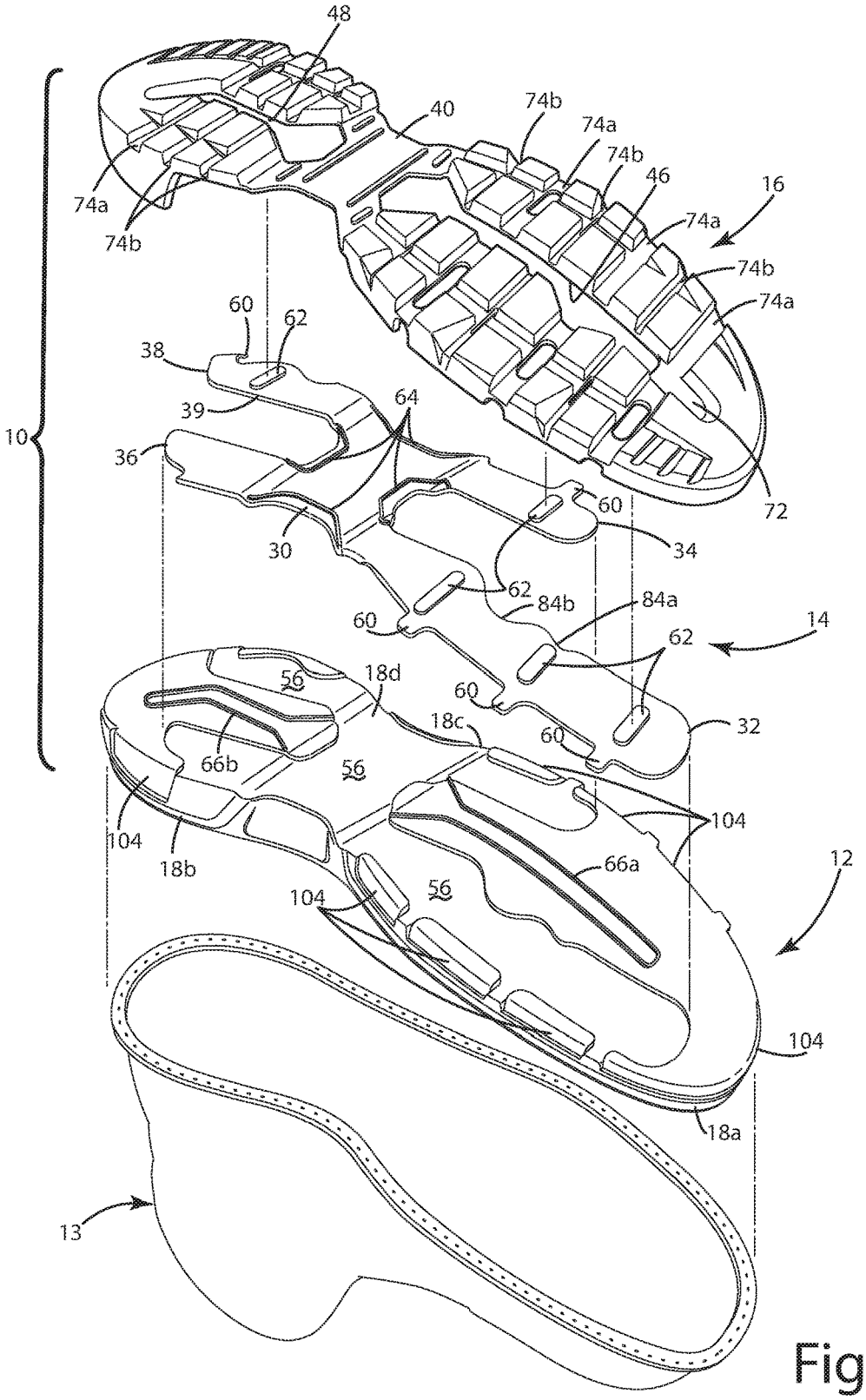
FIG. 2 is a front, right, bottom exploded perspective view of the article of footwear.

An article of footwear 11 incorporating a sole assembly 10 in accordance with an embodiment of the present invention in shown in FIG. 1. The article of footwear 11 shown in FIG. 1 includes a schematic representation of an upper 13. The sole assembly 10 is secured to the bottom of the upper 13. As shown in FIGS. 1 and 2. The outsole assembly 10 generally includes a midsole 12, a plate 14 and an outsole 16. The midsole 12 of this embodiment includes forefoot and heel channels 18*a-b* that provide the forefoot and heel with enhanced compression. In the illustrated embodiment, the plate 14 underlies the midsole 12 and generally includes an arch portion 30 and a plurality of legs 32, 34, 36 and 38 that extend from the arch portion 30. The function of the legs 32, 34, 36 and 38 is affected by the forefoot and channels 18 in the midsole 12. The arch portion 30 is disposed in the arch region of the sole and the legs extend from the arch portion 30 into the forefoot and the heel. The plate 14 of the illustrated embodiment includes medial and lateral forefoot legs and medial and lateral heel legs. In the illustrated embodiment, the outsole 16 underlies the midsole 12 and the plate 14, and is configured to complement the midsole 12 and the plate 14. The illustrated outsole 16 includes an arch portion 40 that extends through the arch region, a forefoot portion 42 that extends through the forefoot and a heel portion 44 that extends through the heel. As shown, the forefoot portion 42 defines a generally longitudinally-extending forefoot slot 46 that generally divides the forefoot portion 42 into lateral and medial parts. Similarly, the illustrated heel portion 44 defines a generally longitudinally-extending heel slot 48 that generally divides the heel portion 44 into lateral and medial parts.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe. The use of directional terms should not be interpreted to limit the invention to any specific orientation.

Further, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot 90, arch 92 and heel 94 regions are generally identified in FIG. 1, however, it is to be understood that delineation of these regions may vary depending upon the configuration of the sole assembly and footwear.

A sole assembly in accordance with the present invention may be joined to essentially any type of footwear upper capable of being joined to a sole. Although shown in FIG. 1 in the context of a mid-height work boot, the present invention is suitable for use as a sole assembly in essentially any type of footwear, including without limitation work boots, safety shoes, performance shoes, hiking shoes, trail shoes and boots, hiking boots, all-terrain shoes, athletic shoes, running shoes, sneakers, tennis shoes, walking shoes, multisport footwear, dress shoes or any other type of footwear or footwear components.

The sole may be joined to the upper using essentially any type of footwear construction, such as a cemented construction, a direct-attach construction (e.g. direct injection molding), a Strobel-stitched construction, a stitchdown construction, a McKay stich construction, a California construction, a force-lasted construction, a slip-lasted construction, a moccasin construction, a direct vulcanizing construction or a welted construction (e.g. Goodyear welt or Blake welt). The upper may be configured to implement the desired footwear construction. For example, the bottom of the upper may be closed with a Strobel-board to implement a Strobel-stitched construction or with an insole board to implement a direct-attached or welted construction.

An illustrative example of a sole assembly manufactured in accordance with an embodiment of the present invention in shown in FIGS. 1, 2, 14 and 15. In the illustrated embodiment, the sole assembly 10 generally includes a midsole 12, a plate 14 and an outsole 16 (See FIG. 2). One of the primary functions of the midsole 12 is to provide resilient cushioning for the wearer's foot. Although the midsole 12 may vary from application to application, the midsole 12 of the illustrated embodiment is manufactured from a relatively resilient material selected to provide the sole assembly 10 with a desired level of cushioning. For example, the midsole 12 may be formed from ethyl vinyl acetate ("EVA") foam, expanded thermoplastic polyurethane ("E-TPU") foam, thermoplastic elastomer ("TPE") foam or polyurethane ("PU") foam. The specific characteristics of the selected foam may vary from application to application. However, in the illustrated embodiment, the midsole 12 hardness is in the range of 55-60 Shore C or more broadly in the range of 40-60 Shore C.

In the illustrated embodiment, the midsole 12 is first manufactured and then attached to the upper (not shown). In this embodiment, the upper surface 50 is configured to be secured to an upper (not shown), for example, to the underside of an insole board, sock liner or other lasting board. The midsole 12 may be secured to the upper (not shown) using any suitable attachment, for example, by adhesives, stitching or a direct-attach method. These are simply examples and the midsole 12 may be secured to the upper using other techniques and apparatus. For example, the midsole 12 may be direct-attached to the upper. Although the illustrated midsole 12 is generally continuous in the illustrated embodiment, it may be implemented in discrete parts.

Figure 4:
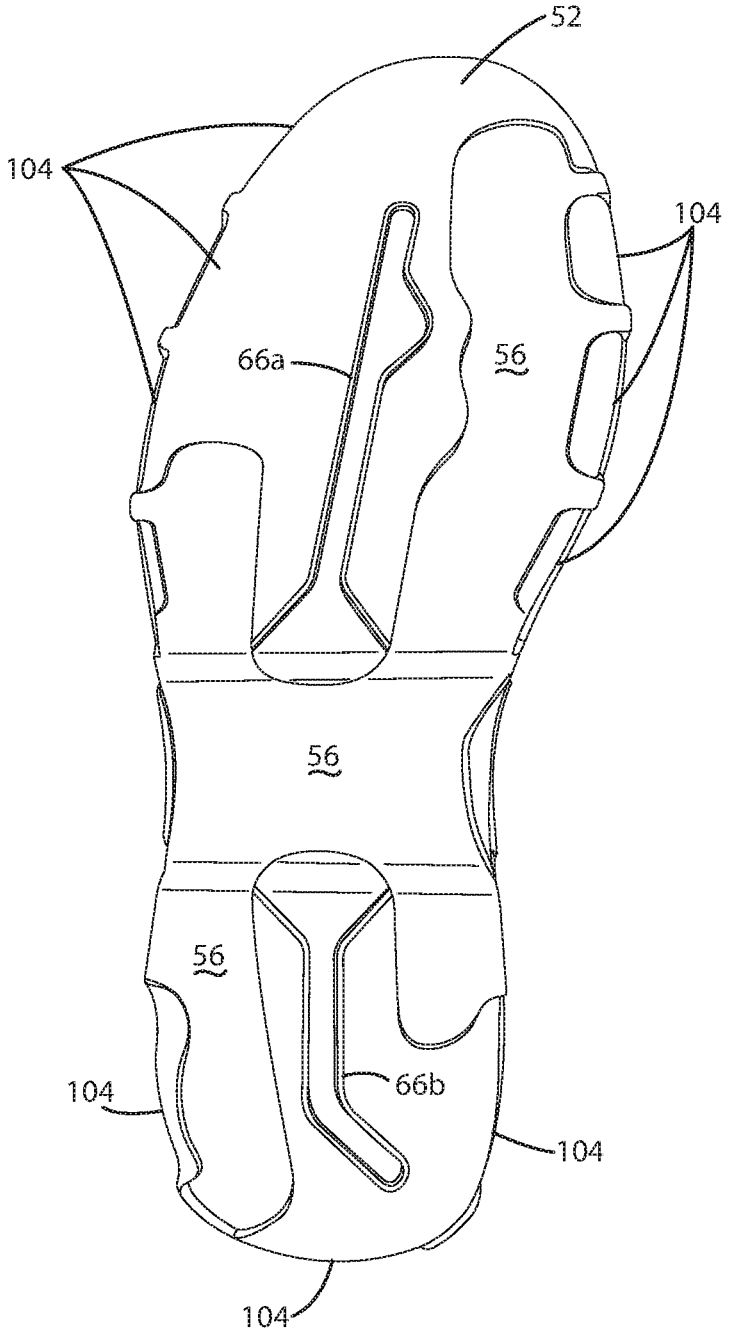
FIG. 4 is a bottom plan view of the midsole
Figure 5:
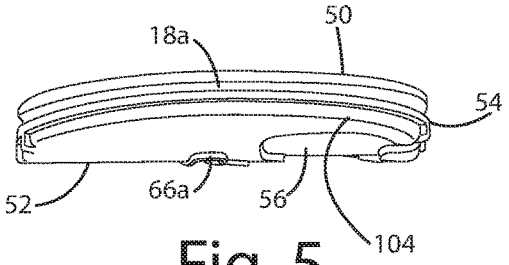
FIG. 5 is a front view of the midsole.
Figure 6:
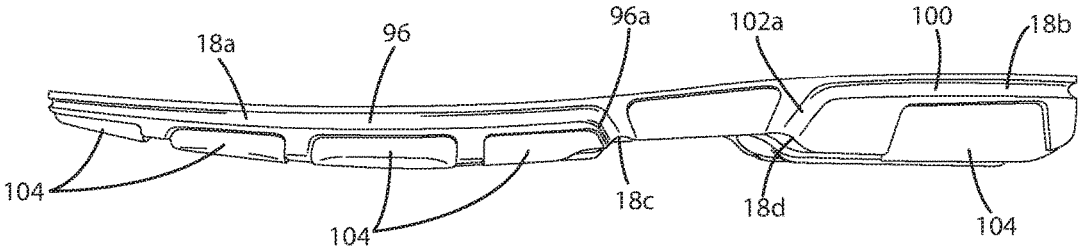
FIG. 6 is a right side view of the midsole.
Figure 7:
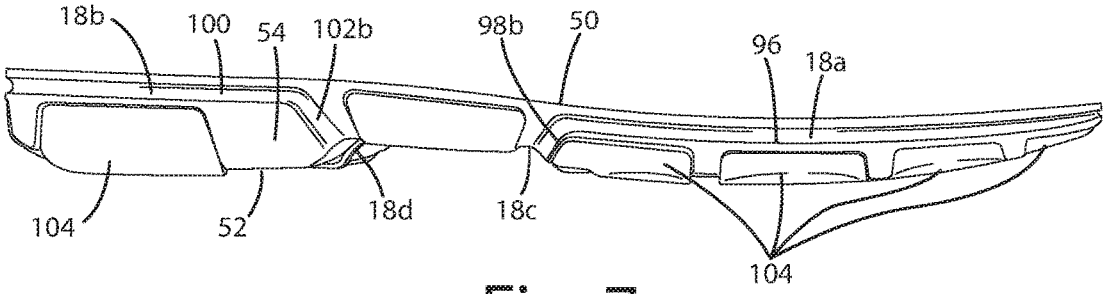
FIG. 7 is a left side view of the midsole.

Referring now to FIGS. 4-8, the midsole 12 of the illustrated embodiment extends essentially the full length and width of the sole assembly 10 and generally includes forefoot, arch and heel portions. The midsole 12 generally includes an upper surface 50, a lower surface 52 and a sidewall 54. The upper surface 50, lower surface 52 and sidewall 54 extend through the forefoot, arch and heel portions. In the illustrated embodiment, the thickness of the midsole 12 varies along its length. For example, as shown in FIGS. 6 and 7, the midsole 12 is somewhat concave in the arch in the sense that the midsole 12 is thinner throughout the arch than in the immediately adjacent portions of the forefoot and the heel. In the illustrated embodiment, the midsole 12 defines a forward arch channel 18*c* and a rearward arch channel 18*d* that extend across the arch of the midsole 12 (See FIGS. 6 and 7). In this embodiment, the forward arch channel 18*c* and rearward arch channel 18*d* extend laterally across the midsole 12 at the forward and rearward ends of the arch. The number, size, shape and configuration of the arch channels 18*c* and 18*d* may be varied to adjust the performance characteristics of the midsole 12. For example, deeper and/or wider channel segments may provide increased flexibility at the forward and rearward edges of the arch.

As noted above, the midsole 12 defines channels 18 that extend along the sidewall 54 in the forefoot and the heel regions. More specifically, the midsole 12 defines a forefoot channel 18*a* and a heel channel 18*b*. In this application, the sidewall channels 18 are configured to make it easier for the midsole 12 to compress under load—particularly in the marginal portion of the midsole 12 around the peripheral edge of the sole assembly 10. The characteristics of the channels 18 may be varied to tune the level of compression. In the illustrated embodiment, the channels 18 have a depth of approximately 3.0 mm and a width of approximately 4.5 mm, but the depth and width may vary from application to application. The depth and width of the channels 18 may vary from location to location to provided localized variation in the performance characteristic of the midsole 12. In this embodiment, the sidewall channels are continuous, but they may be discontinuous in alternative embodiments. For example, the sidewall channels may be eliminated in select portions of the midsole.

As perhaps best shown in FIGS. 5-7, the forefoot channel 18*a* of the illustrated embodiment extends around the perimeter of the forefoot and generally includes a main segment 96 and a pair of transition segments 98*a-b*. In this embodiment, the forefoot channel 18*a* begins and terminates at opposite ends of the forward arch channel 18*c*. The main segment 96 of the forefoot channel 18*a* extends generally parallel to the upper surface 50 centered at approximately one-half of the distance between the upper surface 50 and the lower surface 52. The position of the main segment 96 on the sidewall 54 may, however, vary from application to application, as desired. For example, main segment 96 may be raised or lowered along the sidewall 54. Although the illustrated main segment 96 remains substantially centered on the sidewall around the periphery of the forefoot, the position of the main segment 96 on the sidewall 54 may exhibit localized variations around the forefoot. In the illustrated embodiment, the forefoot channel 18*a* includes transition segments 98*a-b* that are disposed at opposite ends of the main segment 96 to join opposite ends of the main segment 96 to opposite ends of the forward arch channel 18*c*. The transition segments 98*a-b* may extend downwardly from the main segment 96 as shown in FIGS. 6 and 7. The depth of the transition segments 98*a-b* may vary. For example, the transition segments 98*a-b* may have essentially the same depth as the main segment 96, but may become increasingly shallower as they approach the forward arch channel 18*c*. In the illustrated embodiment, the transition segments 98*a-b* taper down to essentially no depth immediately adjacent to the opposite ends of the forward arch channel 18*c*.

Figure 8:
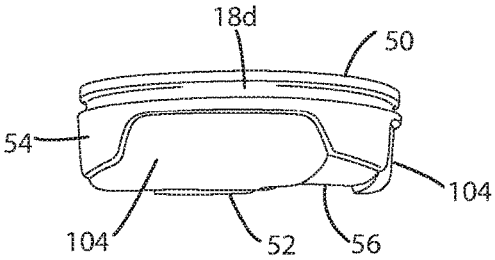
FIG. 8 is a rear view of the midsole.
Figure 9:
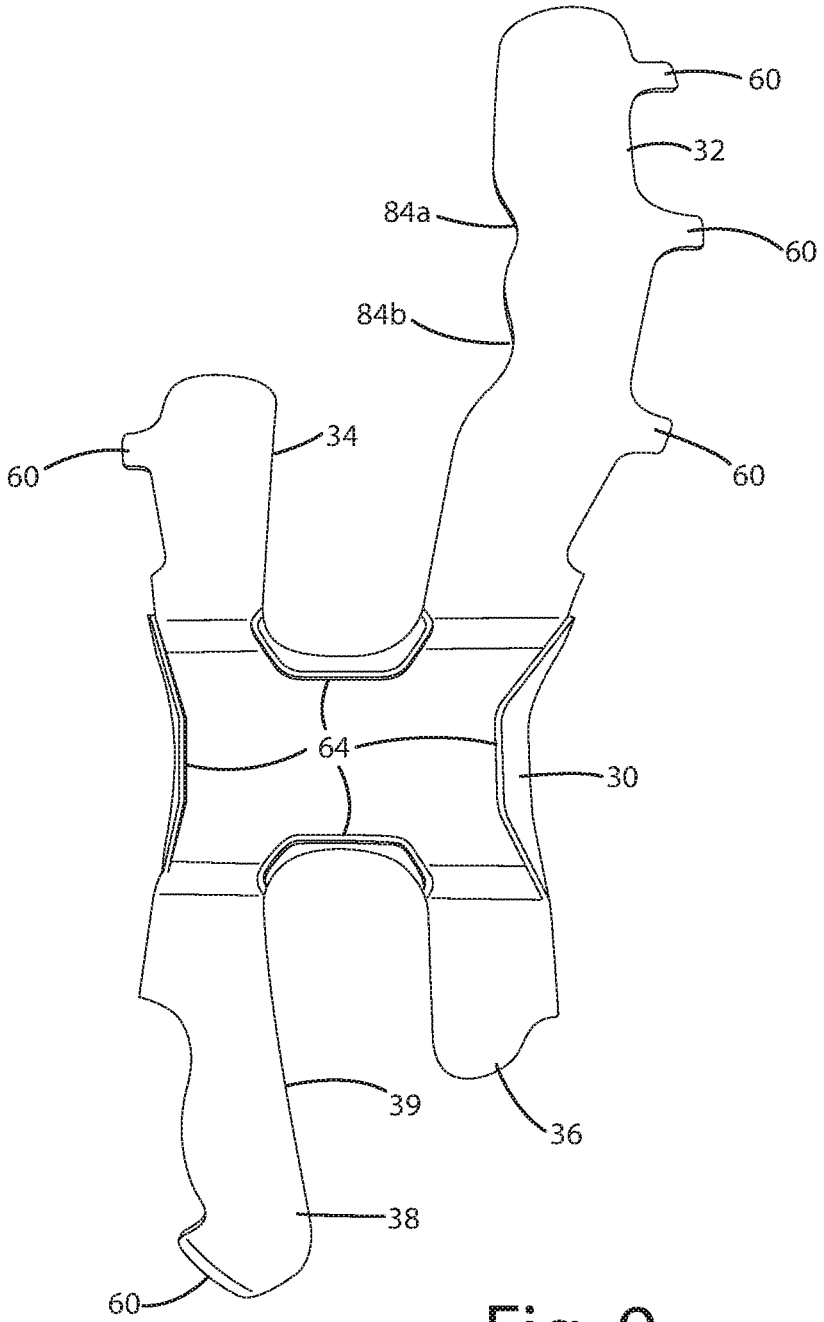
FIG. 9 is a bottom plan view of the plate.

As perhaps best shown in FIGS. 6-8, the midsole 12 also defines a heel channel 18*b* that is formed in the sidewall 54 around the perimeter of the heel. The heel channel 18*b* generally includes a main segment 100 and a pair of transition segments 102*a-b*. In this embodiment, the heel channel 18*b* begins and terminates at opposite ends of the rearward arch channel 18*d*. The main segment 100 of the heel channel 18*b* extends generally parallel to and is spaced a small distance below the upper surface 50 of the midsole 12. This disposes the main segment 100 of the heel channel 18*b* above the uppermost extent of the outsole 16, including the uppermost extent of the outsole wall 88. The position of the main segment 100 on the sidewall 54 may, however, vary from application to application, as desired. For example, main segment 100 may be raised or lowered along the sidewall 54. Although the illustrated main segment 100 of the heel channel 18*b* follows a generally linear profile around the periphery of the heel, the position of the main segment 100 relative to the upper surface 50 may vary around the heel. For example, the main segment 100 of the heel channel 18*b* may follow the uppermost edge of the outsole 16 instead of the upper surface 50 of the midsole 12. In the illustrated embodiment, the heel channel 18*b* includes transition segments 102*a-b* that are disposed at opposite ends of the main segment 100 and join the main segment 100 to the rearward arch channel 18*d* on opposite sides of the sole assembly 10. The transition segments 102*a-b* may extend downwardly from the main segment 100 as shown in FIGS. 6 and 7. The depth of the transition segments 102*a-b* may vary. For example, the transition segments 102*a-b* may have essentially the same depth as the main segment 100, but may become increasingly shallower as they approach the rearward arch channel 18*d*. In the illustrated embodiment, the transition segments 102*a-b* taper down to essentially no depth immediately adjacent to the opposite ends of the rearward arch channel 18*d*.

The forefoot and heel channels 18*a* and 18*b* of the illustrated embodiment are merely exemplary, and may be varied from application to application to adjust the characteristics of the sole assembly 10. For example, the number, position, depth, width and cross-sectional shape of the channels may be varied to tune the midsole 12. These variations may be used to provide global or localized variation in the cushioning and support characteristics of the sole assembly 10.

Figure 3:
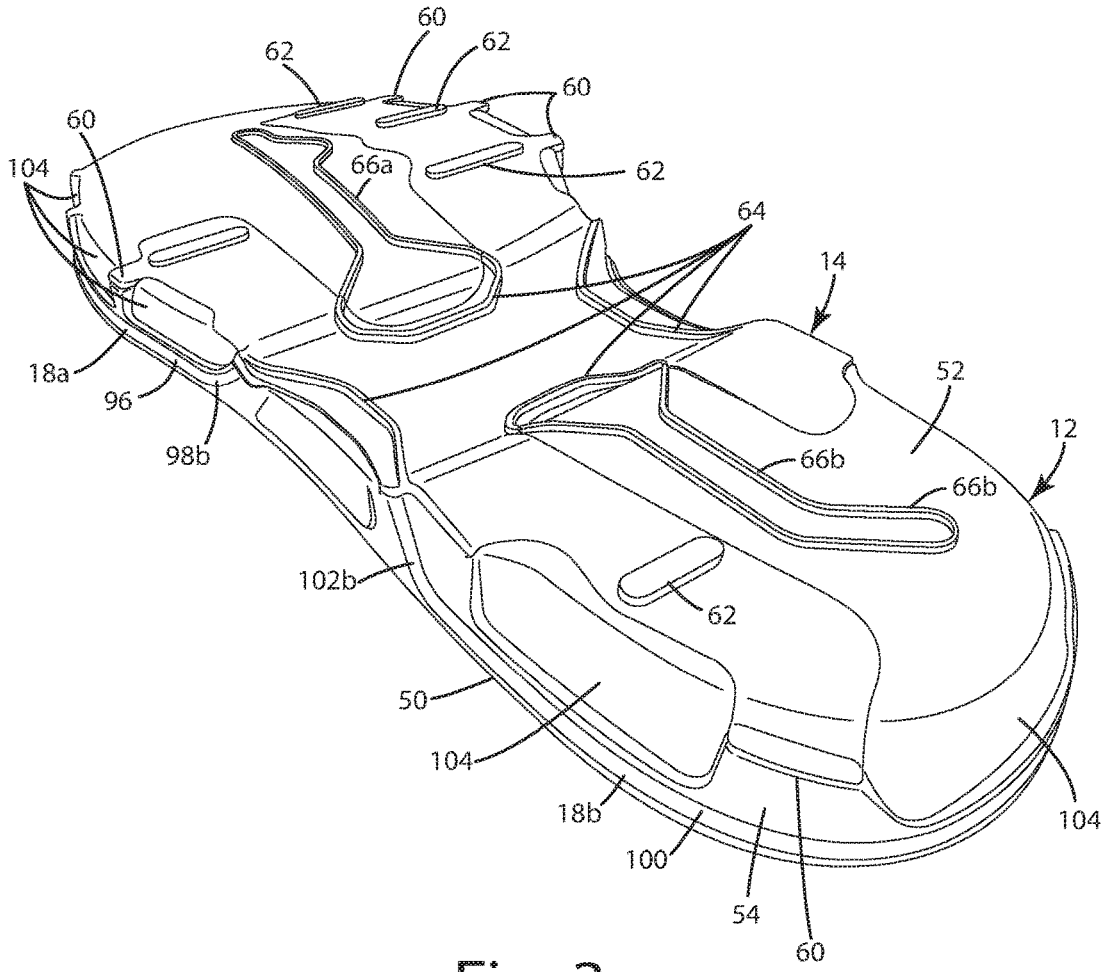
FIG. 3 is a rear, left, bottom perspective view of the sole assembly with the outsole removed.

Referring now to FIGS. 2-4, the midsole 12 may also include a forefoot rib 66*a* and a heel rib 66*b* that extend from the lower surface of the midsole 12. The forefoot and heel ribs 66*a-b* are configured to provide a structure outlining the forefoot and heel slots in the outsole 16. In use, the forefoot and heel ribs 66*a-b* may provide a structure to help locate and retain the outsole 16 with respect to the midsole 12. They may also help to prevent separation by shielding the seam between the midsole 12 and the outsole 16. The location, number, size, shape arrangement and configuration of the ribs 66 may vary from application to application. For example, the ribs may be varied to correspond with variations in the slot in the outsole 16.

In the illustrated embodiment, the lower surface 52 of the midsole 12 defines a plate recess 56 configured to receive the plate 14, as described in more detail below. As shown, the plate recess 56 may be essentially coextensive with the plate 14 and be of sufficient depth to cause the lower surface of the plate 14 to extend in alignment with the lower surface 52 of the midsole 12.

Similarly, the sidewall 54 of the midsole 12 may define a plurality of outsole recesses 104 configured to receive features of the outsole 16, such as upwardly extending segments of wall 88. Each outsole recess 104 may be essentially coextensive with the corresponding segment of wall 88 seated within that recess 104. Further, each outsole recess 104 may be of sufficient depth to seat the corresponding outsole feature nearly flush with the sidewall 54. In the illustrated embodiment, the outsole recesses 104 are slightly shallower than the segments of wall 88 so that the segments of the wall 88 protrude slightly from the sidewall 54. The configuration of the outsole recesses may vary from application to application as desired.

Figure 16:
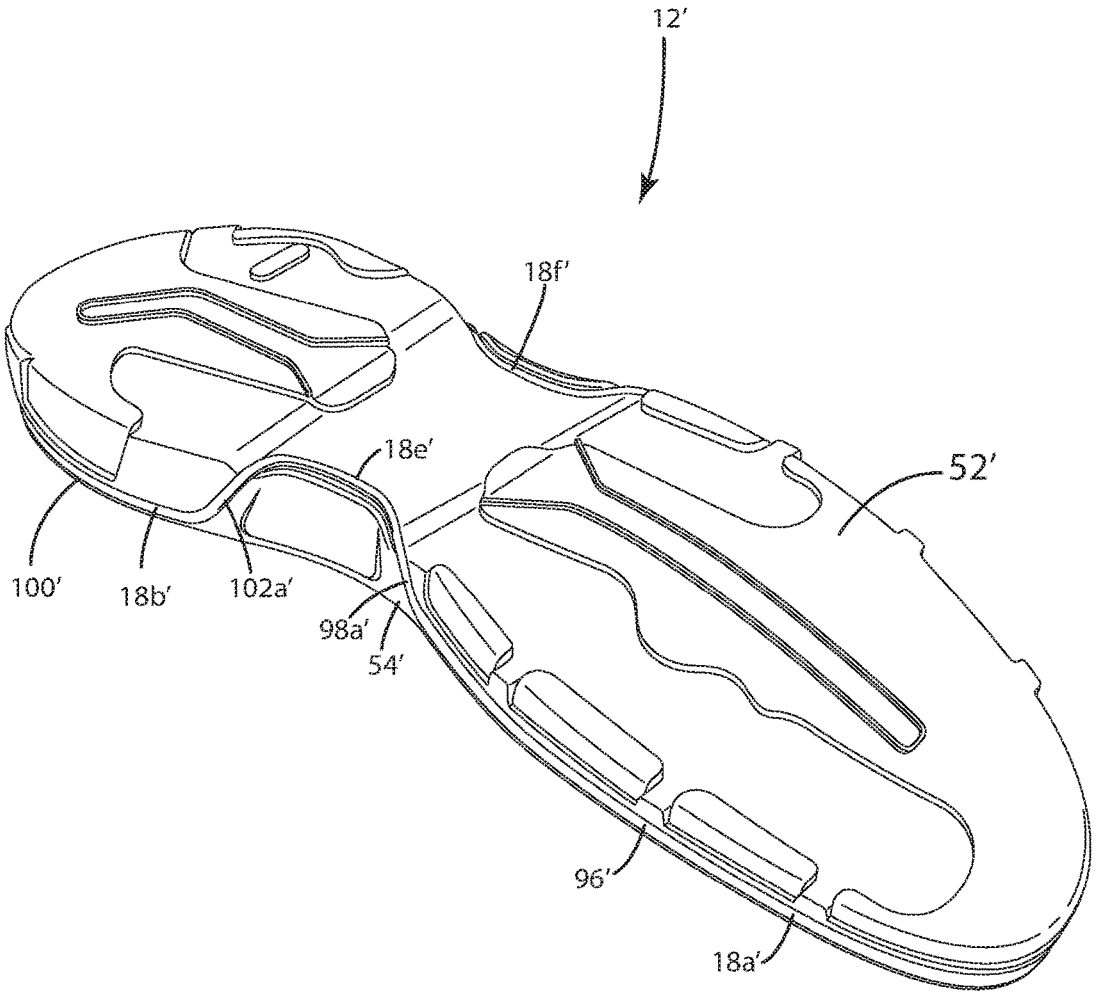
FIG. 16 is a perspective view of an alternative midsole.

In the illustrated embodiment, the forefoot channel 18*a* and the heel channel 18*b* terminate at or before the arch. In alternative embodiments, the forefoot channel and the heel channel may continue into or through arch. For example, in an alternative midsole shown in FIG. 16, the midsole 12' includes a forefoot channel 18*a'* and a heel channel 18*b'* that are joined on opposite sides of the midsole 12' by a medial arch channel segment 18*e'* and a lateral arch channel segment 18*f'*. As shown in FIG. 16, the arch channel segments 18*e'* and 18*f'* may be defined in the bottom surface 52' of the midsole 12' and may extend generally longitudinally just inward from the lateral and medial edges of the bottom surface 52'. In the illustrated embodiment, the transition segments 102*a'* and 98*a'* join the main segments 96' and 100' with the arch channel segments 18*e'* and 18*f'*. The depth and width of the main segments 96' and 100', transition segments 98*a'* and 102*a'* and arch channel segments 18*e'* and 18*f'* are generally consistent throughout their lengths in the illustrated embodiment. The position, size, shape and other characteristics of the arch channel segments 18*e'* and 18*f'* may vary from application to application. For example, the depth and/or width of the arch channel segments 18*e'* and 18*f'* may be varied, universally or locally, to adjust the compression characteristics of the midsole 12'. As another example, the arch channel segments 18*e'* and 18*f'* may be defined in the midsole sidewall 54' rather than the bottom surface 52'.

Figure 10:
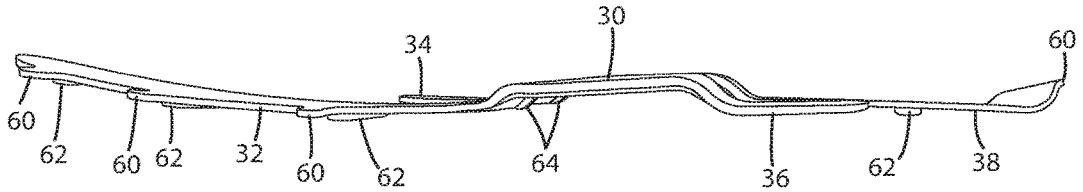
FIG. 10 is a right side view of the plate.

As discussed above, the sole assembly 10 includes a plate 14 positioned below the midsole 12. In the illustrated embodiment, the plate 14 is generally H-shaped with legs that extend from the arch into the forefoot and the heel. More specifically, the plate 14 shown in FIGS. 2, 3, 9 and 10 includes an arch portion 30 that extends laterally across at least a portion of the midsole 12 and a plurality of legs 32, 34, 36 and 38 that extend from the arch portion 30 into the forefoot and the heel. As perhaps best shown in FIG. 10, the arch portion 30 may be recessed somewhat from the longitudinal extent of the legs 32, 34, 36 and 38. In the illustrated embodiment, the arch portion 30 is generally coextensive with the arch region of the midsole 12 terminating short of the lateral and medial sides of the arch region of the midsole 12. The size, shape and configuration of the arch portion 30 may vary from application to application, as desired. For example, the dimensions of the arch portion 30 may be reduced when it is desirable to reduce rigidity or increased when it is desirable to increase rigidity in the arch.

The plate 14 may include a main body with an outer peripheral edge that is spaced a small distance inwardly from the sidewall of the midsole 12, such that the edge of the plate 14 is generally covered by the material of the midsole 12 and/or outsole 16, and is not visible from the exterior of the sole assembly 10. In the illustrated embodiment, the plate 14 include a plurality of small lands 60 that extend outwardly from the main body of the plate 14 to a point generally aligned with the sidewall, such that the lands 60 are visible from the exterior of the sole assembly 10. These lands 60 may help to provide the consumer with a visual indication of the presence of the plate 14.

In the illustrated embodiment, the plate 14 of includes a pair of forefoot legs that extend forwardly from the arch portion 30 along medial and lateral sides of the forefoot. The medial forefoot leg 32 may extend almost the full length of the forefoot terminating short of the toe. The medial forefoot leg 32 may include a pair of notches 84*a-b*. In this embodiment, notch 84*a* is laterally aligned with outsole notch 86 (described below) and notch 84*b* is disposed rearwardly of notch 84*a*. The lateral forefoot leg 34 may extend through only a portion of forefoot. As shown in FIGS. 2 and 3, the lateral forefoot leg 34 extends through approximately half the longitudinal extent of the forefoot terminating short of the balls of the foot. This allows the forward half of the lateral side of the forefoot to flex more easily, for example, forward of the lateral forefoot leg 34 in alignment with outsole notch 86. The size, shape and configuration of forefoot legs 32 and 34 may vary from application to application. For example, the length, width and/or thickness of the forefoot legs 32 and 34 may be varied to control the performance characteristics of the plate 14.

In the illustrated embodiment, the plate 14 includes a pair of heel legs 36 and 38 that extend rearwardly from the arch portion 30 along medial and lateral sides of the heel. As shown, the lateral heel leg 38 of this embodiment is longer than the medial heel leg 36. The medial heel leg 36 may extend approximately half way into the heel. The lateral heel leg 38 may extend almost the full length of the heel and may have an inner edge 39 that extends at an angle into the medial side toward the rear of the heel. As such, the lateral heel leg 38 may extend farther into the central region of the heel and thereby have an improved ability to receive forces exerted during heel strike. As with the forefoot legs, the size, shape and configuration of heel legs 36 and 38 may vary from application to application to control the performance characteristics of the plate 14.

In use, the plate 14 of the illustrated embodiment provides maximum support along a load line that follows the centerline of the gait of a typical consumer, which begins at or near the central rear of the heel during heel strike, follows along the lateral side of the heel, through the arch region and then finally along the medial side of the forefoot to toe off. The shortened forefoot lateral leg and shortened heel medial leg provide appropriate support on the lateral side of the forefoot and the medial side of the heel.

In the illustrated embodiment, the plate 14 is seated in the plate recess 56 defined in the lower surface 52 of the midsole 12 (See FIGS. 2 and 3). As shown, the plate 14 may be generally coextensive with the plate recess 56. The plate 14 need not be fully recessed in the midsole 12, however. For example, the plate 14 may fully or partially protrude from the midsole 12. In alternative embodiments, the outsole 16 may define a plate recess (not shown) configured to receive any portion of the plate 14 protruding beyond the lower surface 52 of the midsole 12.

The plate 14 may also include a plurality of lugs 62 that protrude from the bottom surface of the plate 14 and extend into corresponding openings in the outsole 16. In the illustrated embodiment, the lugs 62 may extend through the thickness of the outsole 16 so that they are visible on the bottom surface of the outsole 16. As shown, the plate 14 may include three lugs 60 along the medial side of the forefoot, one lug 60 on the lateral side of the forefoot and one lug 60 on the lateral side of the heel. The number, size, shape, arrangement and configuration of the lugs may vary from application to application.

In the illustrated embodiment, the plate 14 also includes an arrangement of ribs 64 that protrude downwardly to form a seat for the arch portion 40 of the outsole 16. The ribs 64 help to properly position and hold the outsole 16 with respect to the plate 14. The ribs 64 may also help to prevent separate of the outsole 16 from the plate 14 by shielding the seam between them. As shown, the ribs 64 may form a somewhat "X" shaped seat closely corresponding in shape with the arch portion 40. The number, size, shape, arrangement and configuration of ribs 64 may vary from application to application to correspond with the outsole.

The plate 14 may be manufactured from a wide range of materials depending on the desired physical properties. In the illustrated embodiment, the plate 14 is manufactured from TPU. However, the plate 14 may alternatively be manufactured from any material that provides the desired levels of support and resiliency, such as nylon, reinforced nylon (e.g. glass-filled nylon), TPR, ABS, TPE, polyester elastomers, silicone, polyether block amide ("PEBA") or PVC. In the illustrated embodiment, the plate 14 is cemented to the lower surface 52 of the midsole 12, for example, using conventional adhesives. In the illustrated embodiment, the plate 14 is approximately 2.0 mm thick and has a stiffness of approximately 64 Shore D+−3. The thickness and stiffness of the plate 14 may vary from application to application, as desired. For example, the plate may have a thickness in the range of 1.0 mm to 4.0 mm and a stiffness in the range of 50 to 70 Shore D. The plate may have localized variations in thickness, if desired. For example, the arch portion of one or more of the legs may be thicker to provide increased stiffness and support.

The outsole 16 is disposed below the midsole 12 and the plate 14. In the illustrated embodiment, the outsole 16 is manufactured from a single, one-piece layer that extends over portions of the midsole 12 and the plate 14. The outsole 16 may, however, be manufactured from a plurality of discrete segments that are separately secured to the undersurface of the midsole 12 and/or the plate 14. The outsole 16 can be constructed from one or more materials, and the current embodiment is constructed from rubber. Alternatively, the outsole 16 can be constructed from a thermoplastic polyurethane elastomer (TPU), synthetic rubber, nylon or other polymer blends that includes nylon and/or TPU. These materials are merely exemplary, and the outsole 16 can be constructed from essentially any relatively wear resistant polymer, elastomer and/or natural or synthetic rubber or other materials capable of providing the desired functional characteristics. The outsole also can be constructed to include thermoplastic elastomers and/or thermoset elastomers. Other materials such as fiber-reinforced polymers can be used. These can include epoxy, polyethylene, polyester, thermosetting plastic reinforced with carbon, glass and/or aramid fibers.

Figure 11:
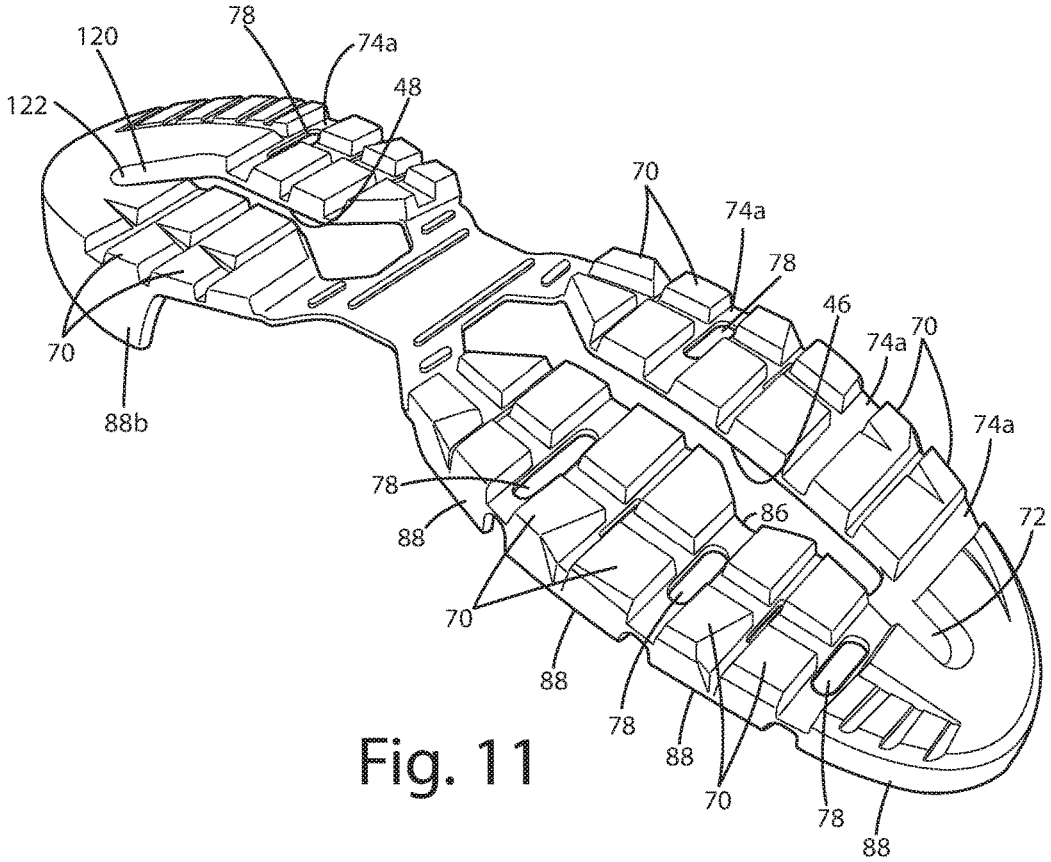
FIG. 11 is a perspective view of the outsole.
Figure 12:
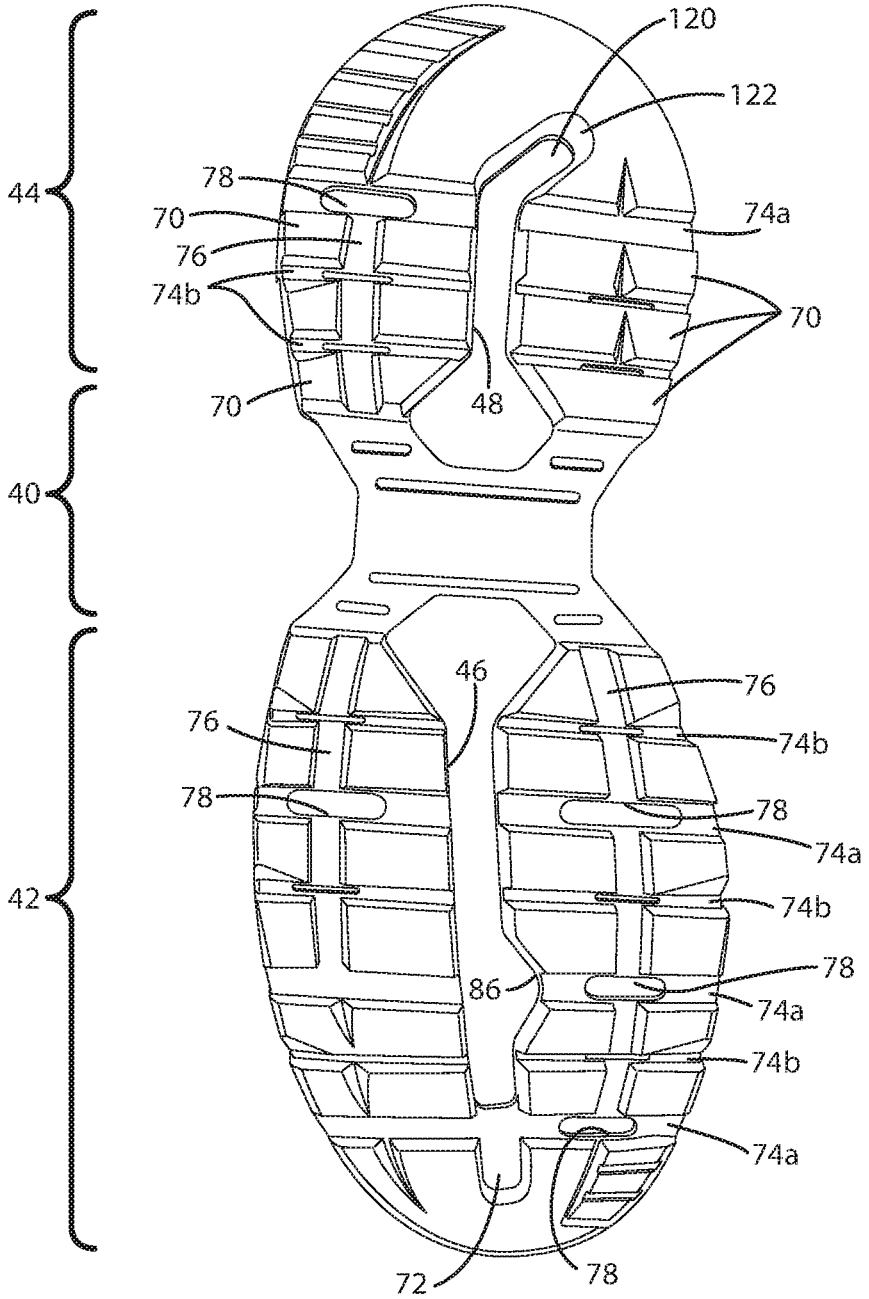
FIG. 12 is a bottom plan view of the outsole.
Figure 13:
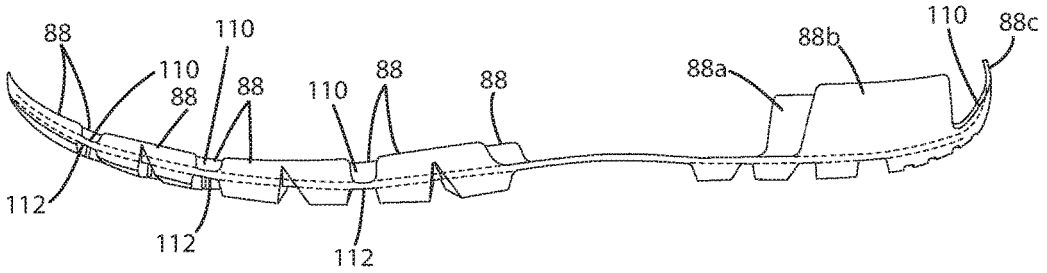
FIG. 13 is a right side view of the outsole.
Figure 14:
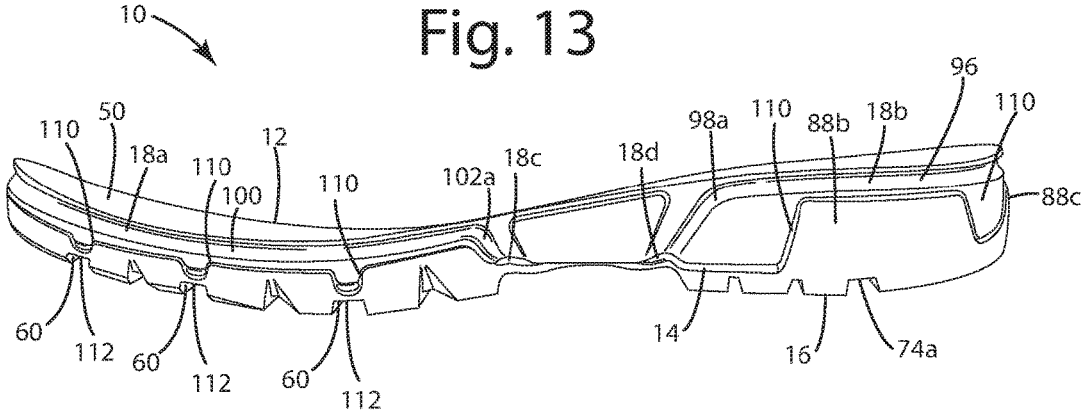
FIG. 14 is a right side view of the sole assembly.
Figure 15:
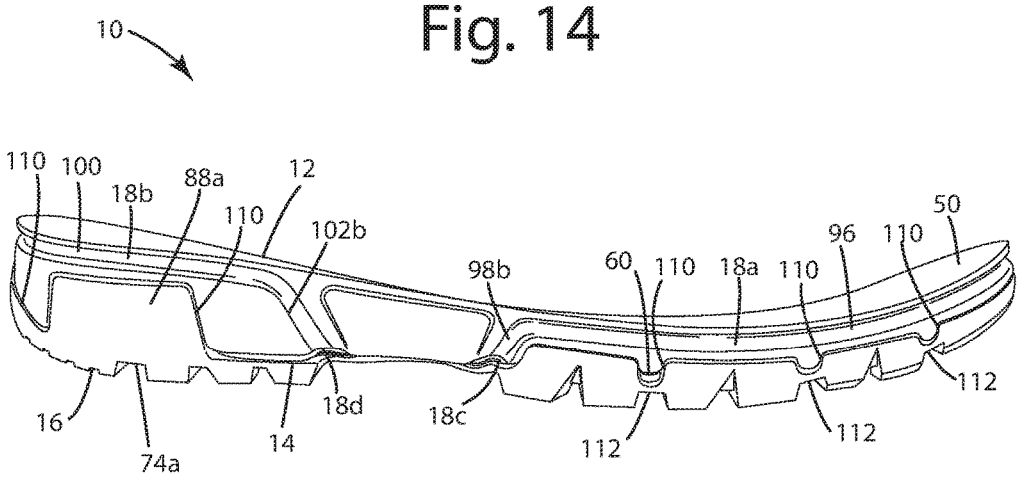
FIG. 15 is a left side view of the sole assembly.

The outsole 16 generally includes a forefoot portion 42, an arch portion 40 and a heel portion 44 (See FIGS. 11-13). The forefoot portion 42 is generally coextensive with the forefoot of the midsole 12. The forefoot portion 42 defines a forefoot slot 46 that extends longitudinally through a portion of the forefoot. The forefoot slot 46 may include a notch 86. As perhaps best shown in FIGS. 1 and 2, the forefoot slot 46 may be configured to fit about the midsole forefoot rib 66*a* and the plate rib 64. The forefoot portion 42 may also define an extension channel 72 that does not pass entirely through the outsole 16. The extension channel 72 of the illustrated embodiment extends forwardly from the forefoot slot 46 to provide additional lateral/medial separation in the forefoot. The bottom surface of the outsole may also include a plurality of ground engaging lugs 70. The number, size, shape, arrangement and configuration of lugs 70 may vary from application to application. However, in this embodiment, the lugs 70 are defined in part by a plurality of lateral lug channels 74*a-b* and longitudinal lug channels 76. In the illustrated embodiment, the lateral lug channels 74*a-b* including primary lateral lug channels 74*a* and secondary lateral lug channels 74*b*. The primary lateral lug channels 74*a* are wider than the secondary lateral lug channels 74*b*. The lateral lug channels 74 not only help to improve traction, but also increase the flexibility of the outsole 16 in the forefoot. The longitudinal lug channels 76 begin at the rearmost edge of the forefoot (i.e. adjacent the arch) and extend forwardly along a gradual curve that follows the approximate centerline of the forefoot legs. The longitudinal lug channels 76 help to improve forefoot flexibility in the lateral direction. The forefoot portion 42 may also define a plurality of apertures 78 that expose small sections of the plate 14. In the illustrated embodiment, the apertures 78 are disposed in the primary lateral lug channels 74*a* and closely receive the plate lugs 62. As shown, the apertures 78 and plate lugs 62 may be of approximately the same size and shape.

The arch portion 40 of the outsole 16 is generally "X"-shaped and it closely fitted into the plate ribs 66. As noted above, the plate ribs 66 may help during assembly to provide proper registration between the arch portion 40 and the plate 14 and may also help to prevent separation during use. In this embodiment, the plate 14 extends beyond and is visible about the edges of the arch portion 40. The arch portion 40 may include lugs or other treads. The size, shape and configuration of the arch portion 40 may vary from application to application, as desired. For example, the arch portion may be eliminated in some applications.

The heel portion 44 defines a heel slot 48. As perhaps best shown in FIGS. 1 and 2, the heel slot 48 may be configured to fit about the midsole heel rib 66*b* and the plate rib 64. The heel slot 48 may include an end section 120 that extends at an angle toward the medial side of the sole assembly. The angled end section 120 may be configured on an angle to provide generally continuous outsole material through the center of the outsole at the rear, which may help the outsole to provide improved support for the forces received during heel strike. The angled end section 120 may terminate at an angled endwall 122 that tapers down in depth to further reduce the outsole material and increases outsole flexibility.

The bottom surface of the outsole may also include a plurality of ground engaging lugs 70. The number, size, shape, arrangement and configuration of lugs 70 may vary from application to application. However, in this embodiment, the lugs 70 are defined in part by a plurality of lateral lug channels 74 and a longitudinal lug channel 76. The lateral lug channels 74 not only help to improve traction, but also increase the flexibility of the outsole 16 in the forefoot. The longitudinal lug channel 76 begins at the forward-most edge of the heel (i.e. adjacent the arch) and extends rearwardly along a gradual curve that follows the approximate centerline of the lateral heel leg 38. The longitudinal lug channel 76 helps to improve heel flexibility and may facilitate loading of the lateral heel leg 38 when placed under load. The configuration of the longitudinal lug channel 76 may be varied to adjust the characteristics of the sole assembly 10. For example, the depth and/or width of the longitudinal lug channel 76 can be increased to increase the flexibility of the outsole 16, thereby placing greater load on the lateral heel leg 38 of the plate 14. The heel portion 44 may also define an aperture 78 that exposes a small section of the plate 14. In the illustrated embodiment, the heel aperture 78 underlies and closely receives the plate lug 62. As shown, the aperture 78 and plate lug 62 may be of approximately the same size and shape.

The outsole 16 of the illustrated embodiment includes a peripheral wall 88 that extends upwardly through portions of the forefoot portion 42 and heel portion 44. In this embodiment, the peripheral wall 88 is discontinuous having a plurality of breaks 110. In the forefoot portion 42, the breaks 110 are vertically aligned with the primary lateral lug channels 74. The combination of breaks 110 and primary lateral lug channels 74 creates flex regions 112 that materially improve the flexibility of the forefoot portion 42 along the lateral lug channels 74. As perhaps best shown in FIG. 13, the forefoot portion 42 includes three flex regions 112—one disposed approximately beneath the toes of the wearer's foot, a second located below the heads of the metatarsals and a third located rearward of the metatarsal heads approximately half way between the metatarsal heads and the arch portion 40. In the heel portion 44 of this embodiment, the breaks 110 are not vertically aligned with the primary lateral lug channels 74. This provides the heel region with greater stiffness. In the illustrated embodiment, the break 110 on the medial side of the of the heel portion 44 is aligned with the end section 120 of the heel slot 48 (See FIG. 14). This reduces the amount of outsole material between the end section 120 and the break 110 on the medial side of the heel portion 44, thereby increasing the flexibility of the outsole 16 in that region. The plate lands 60 are aligned with and visible through the breaks in the forefoot portion 42. In the heel portion 44, the peripheral wall 88 includes a lateral wall section 88*a*, a medial wall section 88*b* and a rear wall section 88*c*. The plate 14 extends into and is visible through the breaks forward of the lateral wall section 88*a* and the medial wall section 88*b*. Similarly, the lateral heel leg 38 extends into and is visible through the break between the lateral wall section 88*a* and the rear wall section 88*c*.

In the illustrated embodiment, the forefoot slot 46 terminates short of the peripheral edge of the toe of the outsole 16. In alternative embodiments, the forefoot slot 46 may extend fully to the peripheral edge of the toe of the outsole 16, thereby creating a greater degree of separation between the lateral and medial parts of the forefoot portion 42 at the toe of the sole assembly 10. Similarly, in the illustrated embodiment, the heel slot 48 terminates short of the peripheral edge of the heel of the outsole 16. In alternative embodiments, the heel slot 48 may extend fully to the peripheral edge of the heel of the outsole 16, thereby creating a greater degree of separation between the lateral and medial parts of the heel portion 44 at the rearmost edge of the sole assembly 10.

Although the illustrated embodiment includes a midsole, plate and outsole that are configured to work in concert, the present invention may be implemented in alternative embodiments with a subset of these components. For example, in some applications, the present invention may be implemented with only a single one of these components or a combination of any two of these components.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A sole assembly comprising:

a midsole having a forefoot region, an arch region and a heel region, said midsole having a sidewall, said midsole defining a forefoot channel extending continuously around said forefoot portion;

a plate joined to said midsole, said plate having an arch portion and a plurality of legs extending from said arch portion, said plurality of legs including a lateral forefoot leg, a medial forefoot leg, a lateral heel leg and a medial heel leg, said lateral forefoot leg and said medial forefoot leg being spaced apart and disposed on opposed sides of said forefoot portion, said lateral heel leg and said medial heel leg being spaced apart and disposed on opposed sides of said heel portion; and an outsole joined to at least one of the midsole and the plate, said outsole including a forefoot portion, an arch portion and a heel portion, said outsole defining at least one of a forefoot slot extending longitudinally through at least a portion of said forefoot portion and a heel slot extending longitudinally through at least a portion of said heel portion.

2. A sole assembly comprising:

a midsole having a forefoot region, an arch region and a heel region, said midsole having a sidewall, said midsole defining a forward lateral channel extending laterally across said arch region of said midsole, said midsole defining a forefoot channel, said forefoot channel being generally continuous and having first and second ends terminating at said forward lateral channel;

a plate joined to said midsole, said plate having an arch portion and a plurality of legs extending from said arch portion, said plurality of legs including a lateral forefoot leg, a medial forefoot leg, a lateral heel leg and a medial heel leg, said lateral forefoot leg and said medial forefoot leg being spaced apart and disposed on opposed sides of said forefoot portion, said lateral heel leg and said medial heel leg being spaced apart and disposed on opposed sides of said heel portion; and an outsole joined to at least one of the midsole and the plate, said outsole including a forefoot portion, an arch portion and a heel portion, said outsole defining at least one of a forefoot slot extending longitudinally through at least a portion of said forefoot portion and a heel slot extending longitudinally through at least a portion of said heel portion.

3. The sole assembly of claim 2 where said midsole defines a heel channel, said heel channel is a continuous channel extending around said heel portion.

4. The sole assembly of claim 2 wherein said midsole defines a rearward lateral channel extending laterally across said arch region of said midsole; and wherein said midsole defines a heel channel, said heel channel being generally continuous and having first and second ends terminating at said rearward lateral channel.

5. A sole assembly comprising:

a midsole having a forefoot region, an arch region and a heel region, said midsole having a sidewall;

a plate joined to said midsole, said plate having an arch portion and a plurality of legs extending from said arch portion, said plurality of legs including a lateral forefoot leg, a medial forefoot leg, a lateral heel leg and a medial heel leg, said lateral forefoot leg and said medial forefoot leg being spaced apart and disposed on opposed sides of said forefoot portion, said lateral heel leg and said medial heel leg being spaced apart and disposed on opposed sides of said heel portion; and an outsole joined to at least one of the midsole and the plate, said outsole including a forefoot portion, an arch portion and a heel portion, said outsole defining at least one of a forefoot slot extending longitudinally through at least a portion of said forefoot portion and a heel slot extending longitudinally through at least a portion of said heel portion, said outsole defining a heel slot, said heel slot including an angled end section, said angled end section extending toward a medial side of said outsole, said lateral leg of said plate including an angled inner edge extending at an angle toward said medial side of the sole assembly.

6. A sole assembly comprising:

a midsole having a forefoot region, an arch region and a heel region, said midsole having a sidewall;

a plate joined to said midsole, said plate having an arch portion and a plurality of legs extending from said arch portion, said plurality of legs including a lateral forefoot leg, a medial forefoot leg, a lateral heel leg and a medial heel leg, said lateral forefoot leg and said medial forefoot leg being spaced apart and disposed on opposed sides of said forefoot portion, said lateral heel leg and said medial heel leg being spaced apart and disposed on opposed sides of said heel portion, said medial forefoot leg extends substantially a full longitudinal length of said forefoot region and said lateral forefoot leg extends about one-half a full longitudinal length of said forefoot, said lateral heel leg extends substantially a full longitudinal length of said heel region and said medial heel leg extends about one-half a full longitudinal length of said heel; and an outsole joined to at least one of the midsole and the plate, said outsole including a forefoot portion, an arch portion and a heel portion, said outsole defining at least one of a forefoot slot extending longitudinally through at least a portion of said forefoot portion and a heel slot extending longitudinally through at least a portion of said heel portion; and wherein said midsole includes a forefoot rib, said forefoot slot fitted about said forefoot rib.

7. The sole assembly of claim 6 wherein said midsole includes a heel rib, said heel slot fitted about said heel rib.

8. The sole assembly of claim 7 wherein said midsole defines a plate recess, said plate fitted closely into said plate recess.

9. The sole assembly of claim 8 wherein said outsole includes an upstanding wall extending from a peripheral edge of said outsole about at least a portion of said outsole forefoot portion, said wall defining a plurality of gaps, said outsole defining a plurality of lateral lug channels aligned with said gaps in said wall.

10. A sole assembly comprising:

a midsole having a forefoot region, an arch region and a heel region, said midsole having a sidewall;

a plate joined to said midsole, said plate having an arch portion and a plurality of legs extending from said arch portion, said plurality of legs including a lateral forefoot leg, a medial forefoot leg, a lateral heel leg and a medial heel leg, said lateral forefoot leg and said medial forefoot leg being spaced apart and disposed on opposed sides of said forefoot portion, said lateral heel leg and said medial heel leg being spaced apart and disposed on opposed sides of said heel portion; and an outsole joined to at least one of the midsole and the plate, said outsole including a forefoot portion, an arch portion and a heel portion, said outsole defining at least one of a forefoot slot extending longitudinally through at least a portion of said forefoot portion and a heel slot extending longitudinally through at least a portion of said heel portion, said forefoot slot terminating short of a forward-most peripheral edge of said forefoot region; and wherein said outsole defines an extension channel, said extension channel extending forwardly from said forefoot slot.

11. An article of footwear comprising:

an upper;

a sole assembly secured to said upper, said sole assembly generally including a midsole, a plate and an outsole;

said midsole having a forefoot region, an arch region and a heel region, said midsole having a sidewall defining a forefoot channel extending about at least a portion of the forefoot region and a heel channel extending about at least a portion of the heel region;

said plate being generally "H"-shaped having an arch portion and a plurality of legs extending from said arch portion, said plurality of legs including a lateral forefoot leg, a medial forefoot leg, a lateral heel leg and a medial heel leg, said lateral forefoot leg and said medial forefoot leg being spaced apart and extending along opposite sides of said forefoot region, said lateral heel leg and said medial heel leg being spaced apart and extending along opposite sides of said heel region; and said outsole including a forefoot portion, an arch portion and a heel portion.

12. The article of footwear of claim 11 wherein said medial forefoot leg extends substantially a full longitudinal length of said forefoot region and said lateral forefoot leg extends about one-half a full longitudinal length of said forefoot; and wherein said lateral heel leg extends substantially a full longitudinal length of said heel region and said medial heel leg extends about one-half a full longitudinal length of said heel.

* * * * *